US008646941B1

(12) United States Patent
McKenna et al.

(10) Patent No.: US 8,646,941 B1
(45) Date of Patent: Feb. 11, 2014

(54) LIGHTING APPARATUS AND METHOD

(75) Inventors: Mark McKenna, New York, NY (US); Amina Chidiac, Brooklyn, NY (US)

(73) Assignee: Humanscale Corporation, New York, NY (US)

( * ) Notice: Subject to any disclaimer, the term of this patent is extended or adjusted under 35 U.S.C. 154(b) by 105 days.

(21) Appl. No.: 13/160,255

(22) Filed: Jun. 14, 2011

Related U.S. Application Data

(60) Provisional application No. 61/354,352, filed on Jun. 14, 2010.

(51) Int. Cl.
*F21V 1/00* (2006.01)

(52) U.S. Cl.
USPC ..... 362/235; 362/249.02; 362/296.01; 362/307; 362/311.02; 362/341

(58) Field of Classification Search
USPC ..... 362/227, 234–235, 240, 245, 249.02, 362/249.12, 296.01, 307–308, 362/311.01–311.02, 311.11, 326–328, 333, 362/341
See application file for complete search history.

(56) References Cited

U.S. PATENT DOCUMENTS

| | | | |
|---|---|---|---|
| 5,136,483 | A | 8/1992 | Schoniger |
| 5,289,365 | A | 2/1994 | Caldwell et al. |
| 5,988,836 | A | 11/1999 | Swarens |
| 6,016,038 | A | 1/2000 | Mueller et al. |
| 6,641,294 | B2 | 11/2003 | Lefebvre |
| 6,758,582 | B1 | 7/2004 | Hsiao et al. |
| 6,793,372 | B2 | 9/2004 | Wehner et al. |
| 6,871,981 | B2 | 3/2005 | Alexanderson et al. |
| 6,871,983 | B2 | 3/2005 | Jacob et al. |
| 6,971,781 | B2 | 12/2005 | Guy |
| 7,080,921 | B2 | 7/2006 | Feldstein |
| 7,148,632 | B2 | 12/2006 | Berman et al. |
| 7,178,943 | B2 | 2/2007 | Holten |
| 7,210,806 | B2 | 5/2007 | Holman et al. |
| 7,217,009 | B2 | 5/2007 | Klose |
| 7,221,104 | B2 | 5/2007 | Lys et al. |
| 7,255,459 | B2 | 8/2007 | Kuan et al. |
| 7,270,448 | B1 | 9/2007 | Maley, Sr. |

(Continued)

FOREIGN PATENT DOCUMENTS

| | | |
|---|---|---|
| CN | 100475289 | 4/2009 |
| CN | 201359257 | 12/2009 |

(Continued)

OTHER PUBLICATIONS

Green Lighting LED; "Dimmable LED Lighting: energy-efficient dimming technology"; LEDs Magazine; Oct. 21, 2009; www.greenlightingled.com/LED-Lighting-News-Press-Events/Dimmable-LED-Lighting-Technology-Press-Release.aspx.

(Continued)

*Primary Examiner* — Stephen F Husar
*Assistant Examiner* — Meghan Dunwiddie
(74) *Attorney, Agent, or Firm* — Jones Walker LLP

(57) ABSTRACT

In the specification and drawings a lighting apparatus is described and shown with a first light source having a light output with a central axis; a first reflector; and a first lens positioned between said first light source and said first reflector, such that at least a portion of the light output of said first light source passes through said first lens, and is redirected by said first reflector. Also described and shown in the specification and drawings is a lighting apparatus kit, as well as a method of illuminating an area.

29 Claims, 15 Drawing Sheets

(56) References Cited

U.S. PATENT DOCUMENTS

| | | | |
|---|---|---|---|
| 7,281,823 | B2 | 10/2007 | Moisel |
| 7,318,652 | B2 | 1/2008 | Pohlert et al. |
| 7,327,930 | B2 | 2/2008 | Koren et al. |
| 7,598,686 | B2 | 10/2009 | Lys et al. |
| 7,658,513 | B2 | 2/2010 | Peck |
| 2006/0226795 | A1 | 10/2006 | Walter et al. |
| 2007/0290629 | A1 | 12/2007 | Koren |
| 2008/0025028 | A1 | 1/2008 | Gloisten et al. |
| 2008/0094005 | A1 | 4/2008 | Rabiner et al. |
| 2008/0123340 | A1 | 5/2008 | McClellan |
| 2008/0192499 | A1 | 8/2008 | Gardner et al. |
| 2009/0096392 | A1 | 4/2009 | Chandran et al. |
| 2009/0278471 | A1 | 11/2009 | Peng |
| 2009/0296390 | A1 | 12/2009 | Dubord |

FOREIGN PATENT DOCUMENTS

| | | |
|---|---|---|
| JP | 57141174 | 9/1982 |
| JP | 2007080866 | 3/2007 |
| JP | 2007294169 | 11/2007 |
| JP | 2008034124 | 2/2008 |
| JP | 2008210536 | 9/2008 |
| JP | 2009277582 | 11/2009 |

OTHER PUBLICATIONS

Jiayin Lu, Xiaobo Wu, Inst. of VLSI Design, Zhejiang Univ., Hangzhou, China; "A novel multiple modes PWM controller for LEDs"; Circuits and Systems, 2009; May 24-27, 2009; pp. 1767-1770; Taipei.

Supertex Inc.; "Programmable-Current LED Lamp Driver IC with PWM Dimming"; Doc. #DSFP-HV9925; 2008; Sunnyvale, California.

Phillips; "Why Phillips Color Kinetics LED Lighting"; 2009.

Dan Goldwater; "RGB Color Controllable High Power LED Room + Spot Lighting"; Jan. 8, 2007; Support DIY and Instructables.

Peter Tod; "Technology and Application of LEDs"; May 2009; LEDs Magazine—LED Design Forum: Optimized control schemes improve LED driver performance.

"Built-in cieling LED lights (LED downlighters)"; 2010; Slovenija.

"LED Truck Lights"; At least as early as May 5, 2010.

Donald Hirsh & Robert Wood, "Light Management Films in LED-based Luminaire Design"; Bright View Technologies, Inc.; Morrisville, North Carolina, USA; At least as early as May 5, 2010.

The Encylclopedia of Alternative Energy and Sustainable Living; "kitchen undercabinet lighting"; At least as early as May 5, 2010.

"Binay's LED Streetlight Luminairies"; At least as early as May 5, 2010.

Global Spec; "About Lamps"; "Products & Services Related to Lamps"; At least as early as May 5, 2010.

James Ho, Arrow Asia Pac; "Arrow Lighting—Lens and Optics Solution for LED Lighting"; At least as early as May 5, 2010.

The LED Light.com; High Power Spot and Floodlights; At least as early as May 5, 2010.

Renaissance Lighting; "White LED downlights by Renaissance Lighting"; At least as early as May 5, 2010.

Progressive Growth; "Reflectors & Reflective Materials"; At least as early as May 5, 2010.

LIGHTING APPARATUS AND METHOD

This application claims the benefit of U.S. Provisional Application No. 61/354,352, filed Jun. 14, 2010, which is hereby incorporated by reference.

I. BRIEF DESCRIPTION OF THE SEVERAL VIEWS OF THE DRAWINGS

II. DETAILED DESCRIPTION

Figure 1:
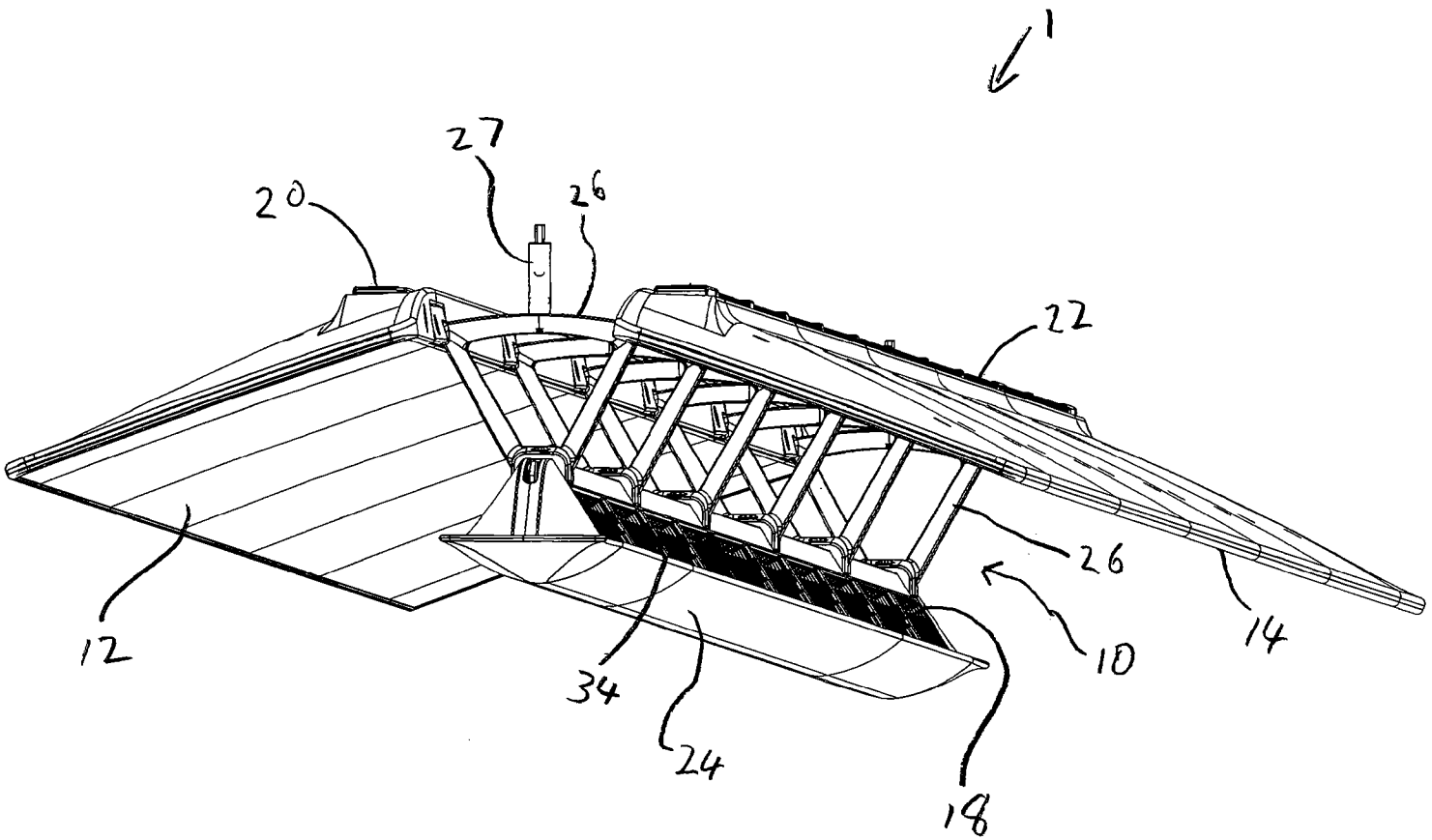
FIG. 1 is a bottom perspective view of an embodiment described herein.
Figure 2:
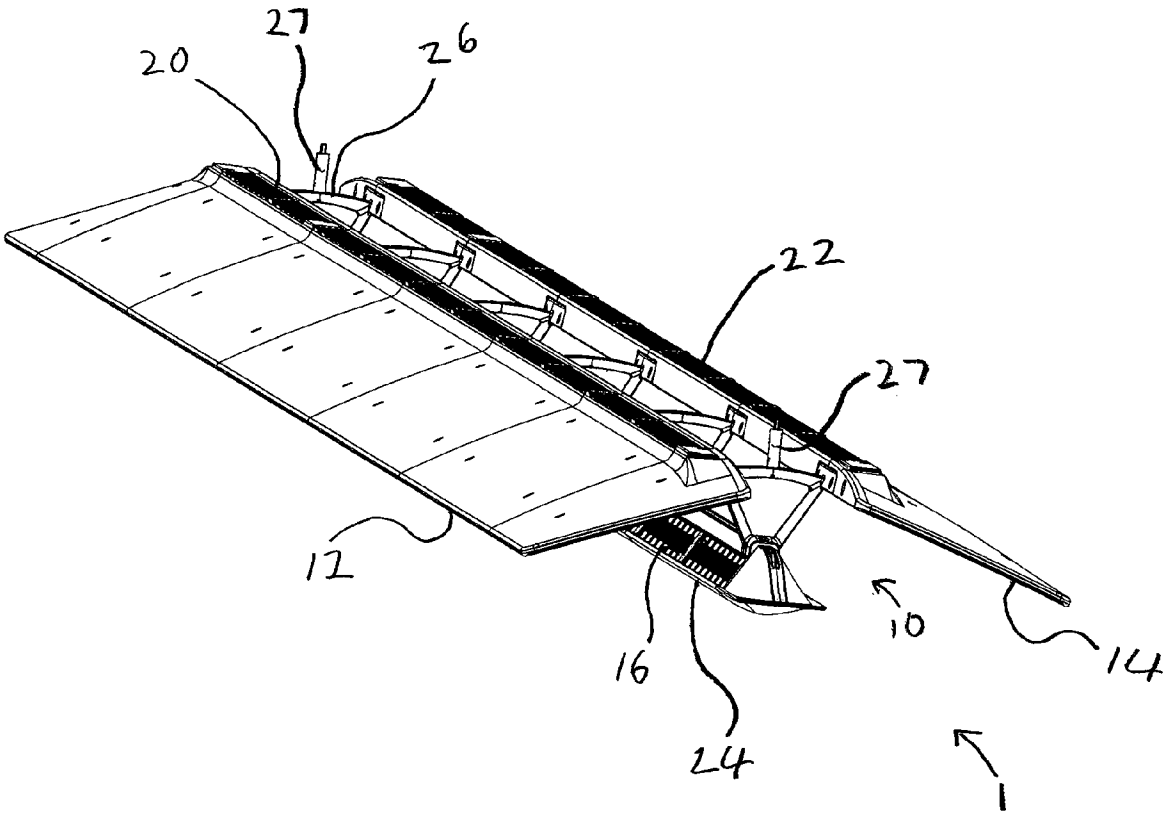
FIG. 2 is top perspective view of an embodiment described herein.

As shown in the accompanying drawings, an embodiment is a lighting apparatus. As shown in FIGS. 1 and 2, an embodiment of the lighting apparatus 1 has a frame 10. A first reflector 12 and second reflector 14 are connected to the frame 10. Also connected to the frame 10 is a first downlight 16 (shown in FIG. 2) and a second downlight 18 (shown in FIG. 1). The light output of the first downlight 16 is directed toward the first reflector 12, and the light output of the second downlight 18 is directed toward the second reflector 14. A first uplight 20 and a second uplight 22 are also connected to the frame 10. The frame 10 can include components such as a heat sink 24, frame connectors 26, hangers 27 and/or additional components. The hangers 27 can be used for purposes such as suspending the lighting apparatus from a ceiling and/or routing power and communication cables. Unless otherwise stated, the term "connected" as used herein includes both a direct connection and an indirect connection.

Figure 3:
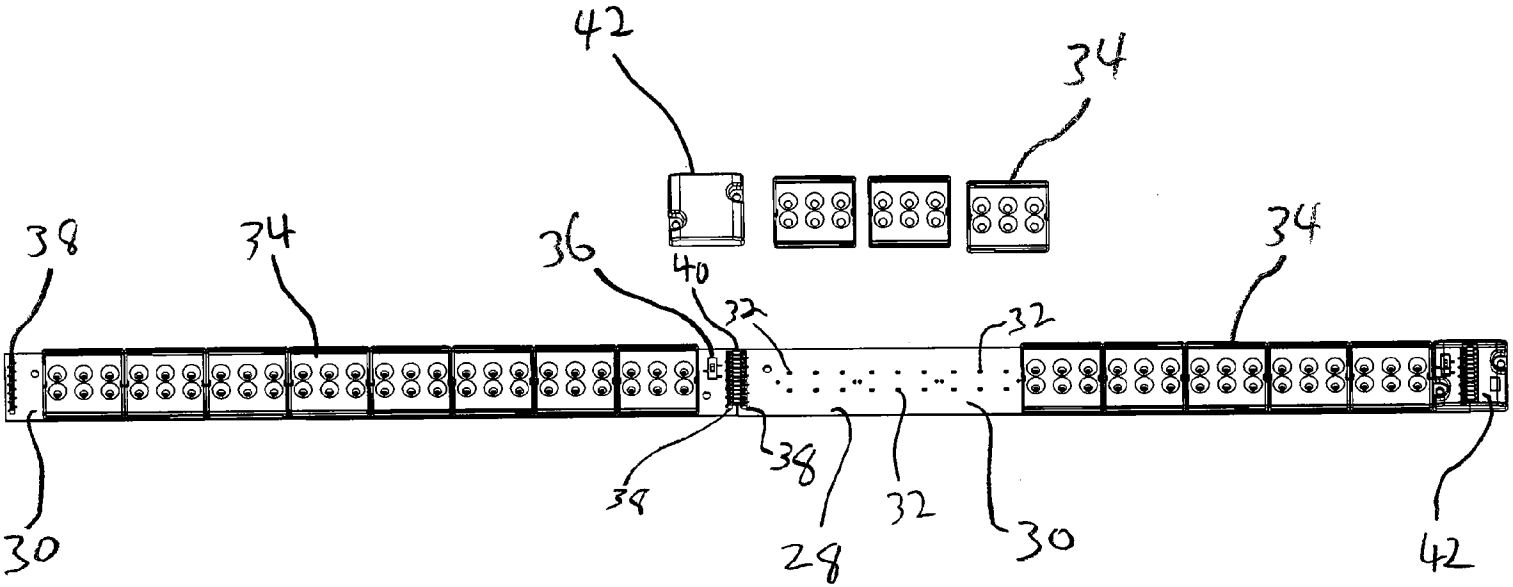
FIG. 3 is a perspective view of an embodiment described herein.

Referring to the embodiments shown in FIGS. 1, 2 and 3, the first downlight 16 and second downlight 18 include a base 28. The base 28 can include one or more printed circuit boards ("PCB") 30, such as a metal core printed circuit board. Although in the embodiments depicted in FIGS. 1 and 2 downlights 16 and 18 each include 10 PCBs, only two PCBs are shown in FIG. 3.

Figure 4:
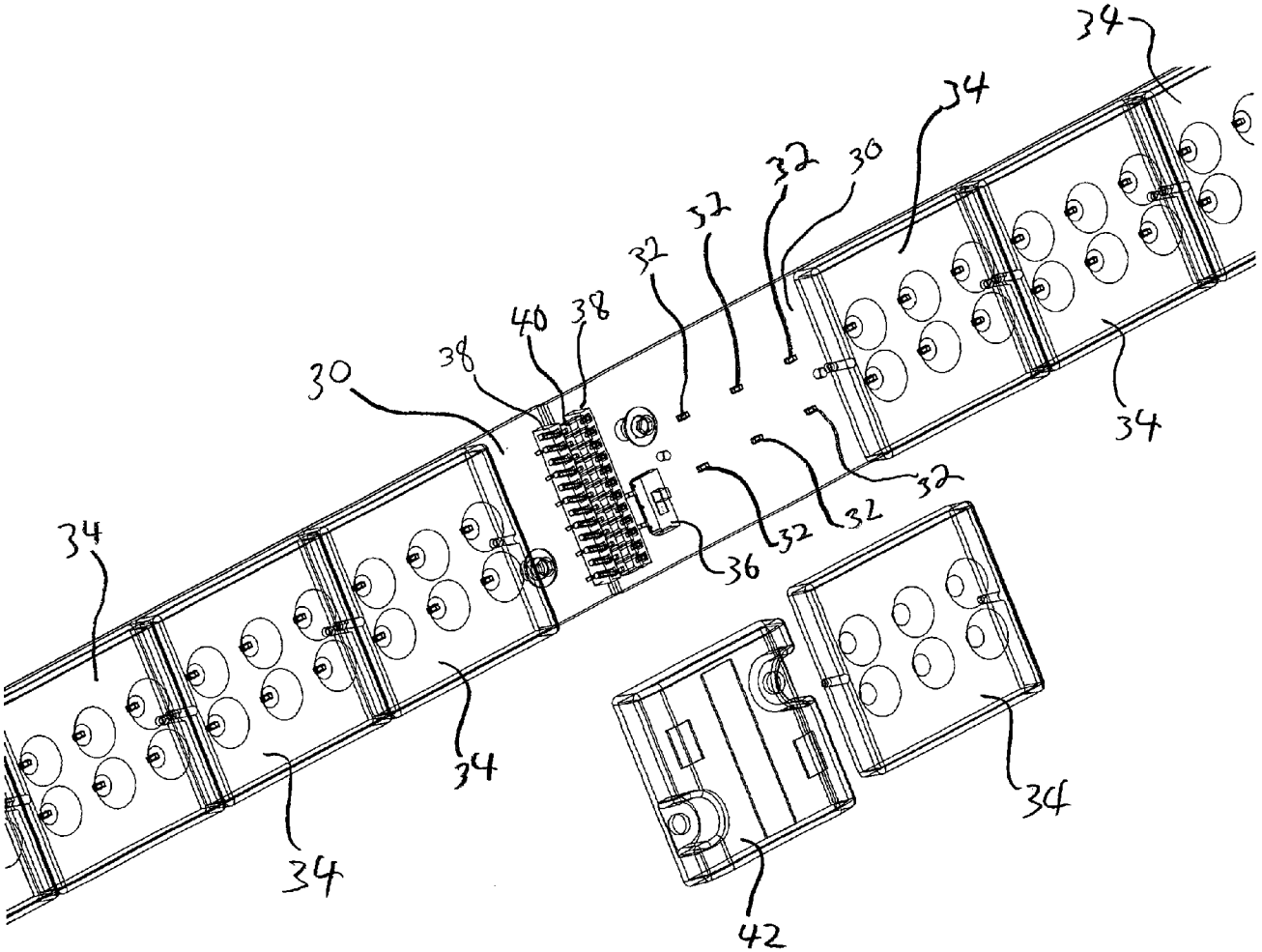
FIG. 4 is a perspective view of an embodiment described herein.
Figure 5:
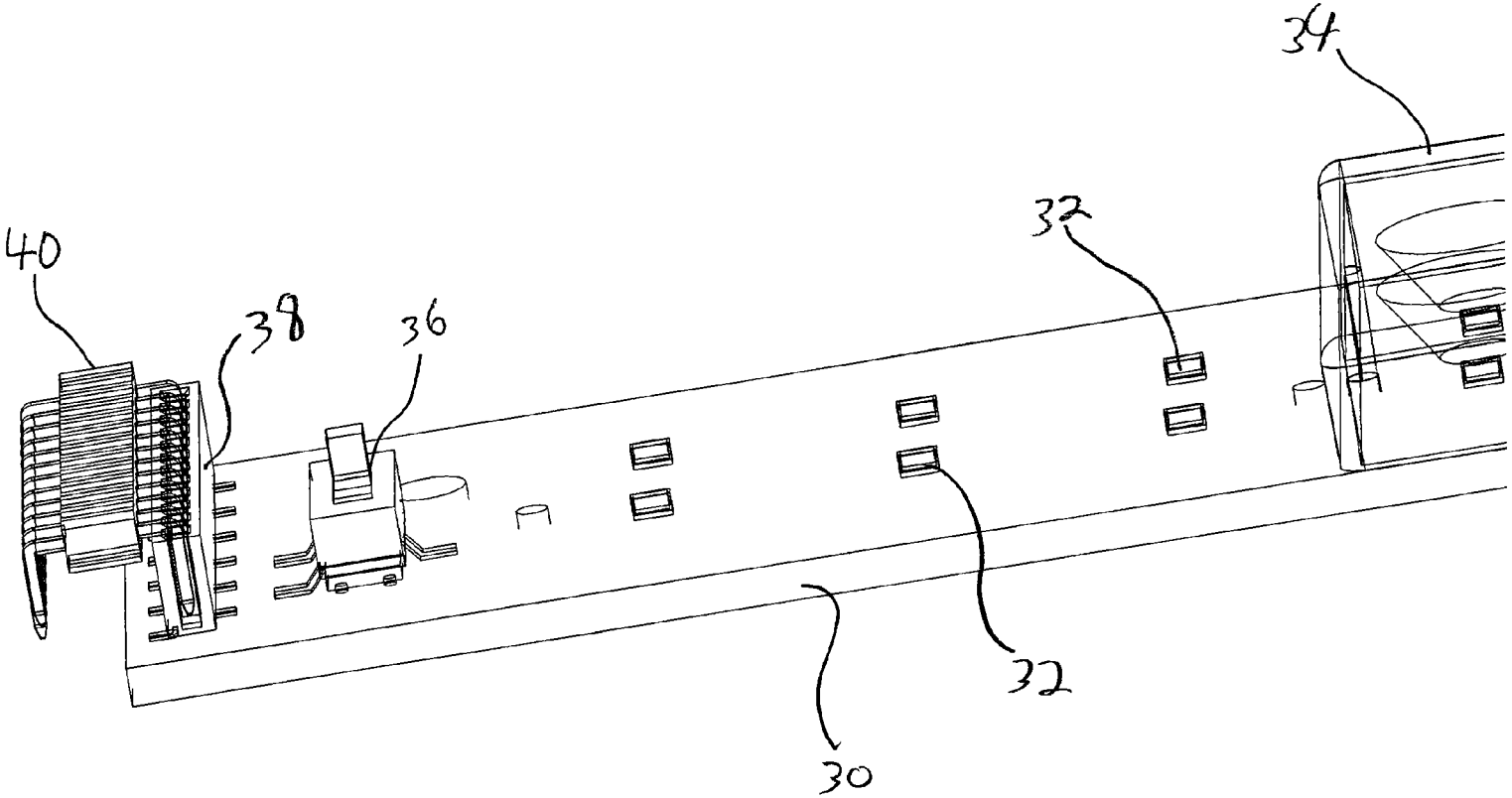
FIG. 5 is a perspective view of an embodiment described herein.

As is shown in FIGS. 3, 4 and 5, each PCB can include one or more light emitting diodes ("LED") 32 mounted to the PCB. In the embodiment depicted in FIG. 3, each PCB is one foot long and has 48 LEDs mounted thereon. A lens 34, such as a polycarbonate optical lens, is mounted over each set of six LEDs. In another embodiment, the number of LEDs per lens can vary. Each PCB can also include a toggle switch 36. In the embodiment depicted in FIGS. 3, 4 and 5 the toggle switch 36 is a manually operated switch with a listen setting and an ignore setting. As opposed to being manually operated, in another embodiment the toggle switch can be electronically operated.

Referring still to the embodiments depicted in FIGS. 3, 4 and 5, on each end of PCB 30 is a female PCB connector 38. A male PCB connector 40 is used to electrically and/or physically interconnect one PCB 30 to another PCB 30, by inserting into a female PCB connector 38 on each end of two adjacent PCBs. A PCB connector cover 42 is mounted over the male and female PCB connectors. The male PCB connector 40 can allow for the communication of information and/or electrical power between two or more interconnected PCBs. Information communicated between two or more interconnected PCBs can include an on/off signal, a pulse width modulation ("PWM") signal for dimming or otherwise controlling the LEDs, or any other type of information. For purposes of clarity, some of the lenses 34 and PCB connector covers 42 have either been detached from the PCB 30 or removed completely from the embodiments depicted in FIGS. 3-5.

Figure 6:
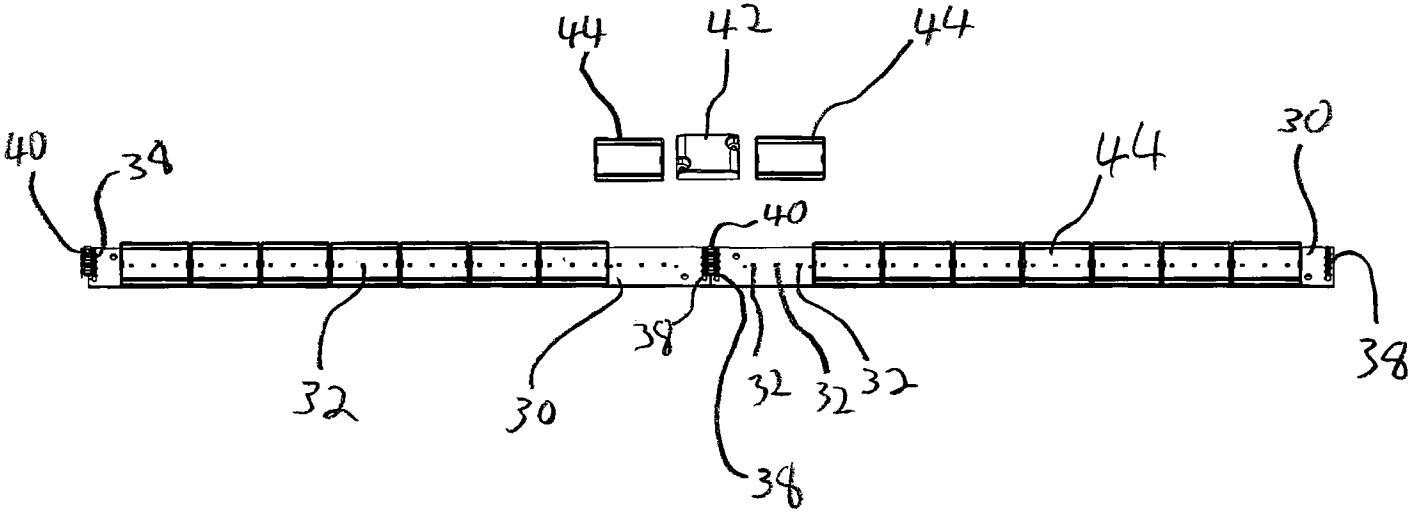
FIG. 6 is a perspective view of an embodiment described herein.
Figure 7:
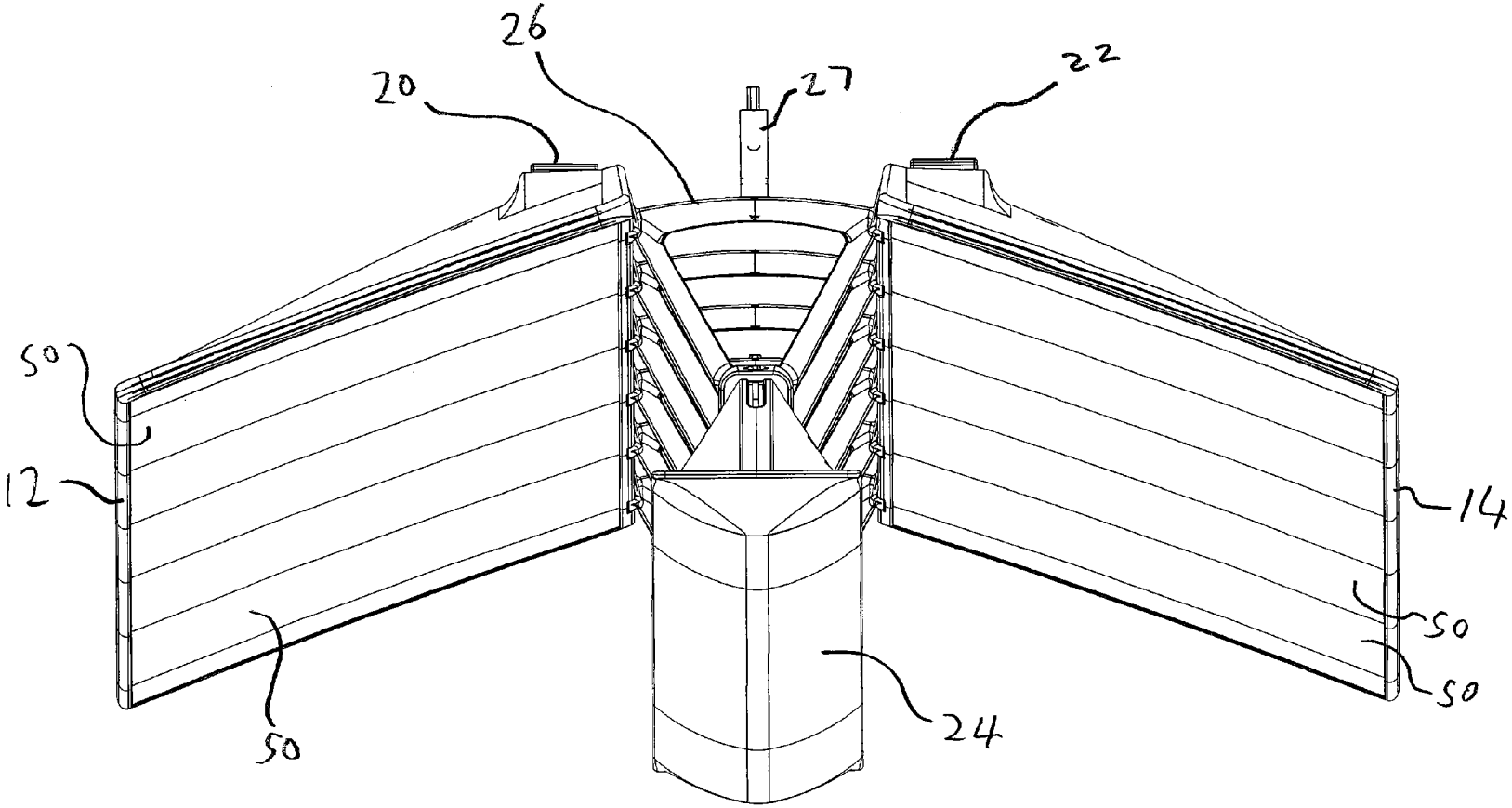
FIG. 7 is a bottom perspective view of an embodiment described herein.
Figure 8:
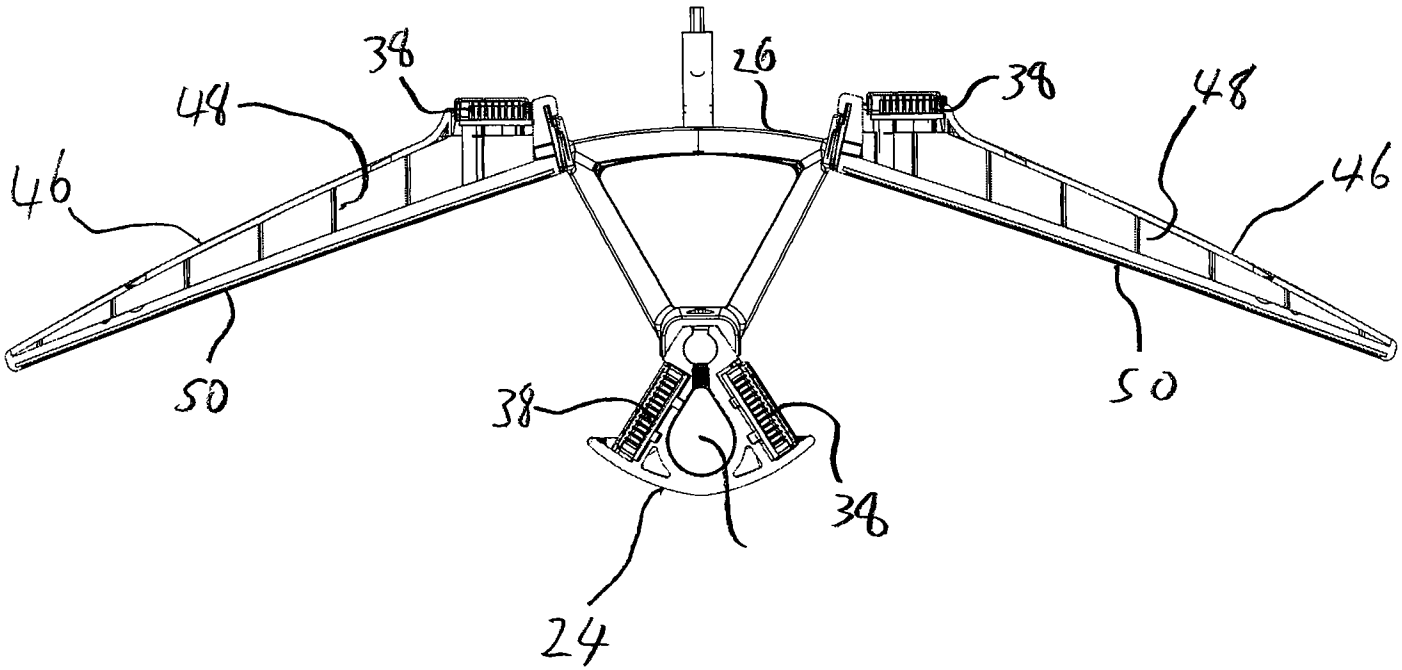
FIG. 8 is a sectional view taken along line 8-8 of FIG. 10.

In an embodiment, uplights 20 and 22 can include identical components as downlights 16 and 18. In another embodiment, as is depicted in FIG. 6, uplights 20 and 22 have PCBs 30, LEDs 32, female PCB connectors 38, male PCB connectors 40, PCB connector covers 42 and a toggle switch (not shown in FIG. 6). In the embodiment depicted in FIG. 6, 24 LEDs are mounted to each PCB, and transparent covers 44 are mounted over each set of three LEDs.

Referring now to FIGS. 7 through 11, in an embodiment first reflector 12 and second reflector 14 can include one or more reflector bodies 48. A reflector cover 46 is attached to the top of each reflector body, and a reflector material such as a replaceable reflector material 50 is attached to the bottom of each reflector body. The replaceable reflector material 50 can be a specular reflector or it can be a diffuse reflector. In an embodiment, both specular and diffuse reflectors can be provided in a kit and can be interchangeable by a user in the field.

Referring still to the embodiments depicted in FIGS. 7-11, the lighting apparatus is made up five interconnected modules 52. In another embodiment, the lighting apparatus can have either more than five or less than five interconnected modules. Each module, when separated, can be a complete lighting apparatus which includes all components and features described herein. In an embodiment, each module is two feet long. One or more modules can be included as part of a kit, with each module being fully assembled, fully disassembled, or at various stages of intermediate assembly. In an embodiment of a kit, the reflectors are disconnected from the remainder of the module and are assembled in the field. In another embodiment of a kit, both the reflectors 12, 14 and the frame connectors 26 are disconnected from the remainder of the module and are assembled in the field.

Figure 9:
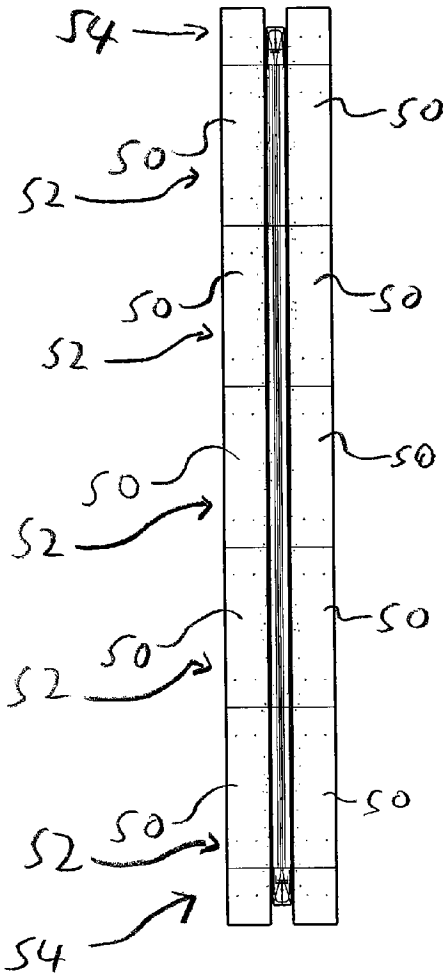
FIG. 9 is a bottom view of an embodiment described herein.
Figure 10:
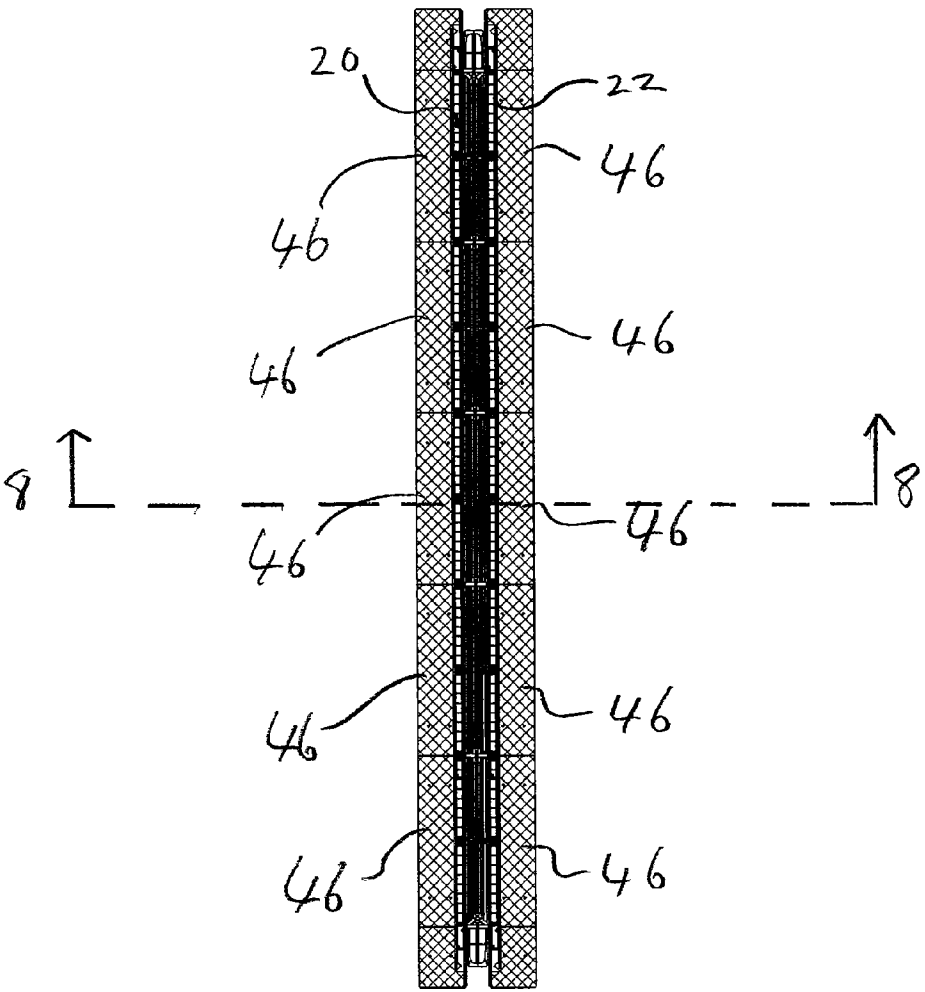
FIG. 10 is a top view of an embodiment described herein.
Figure 11:
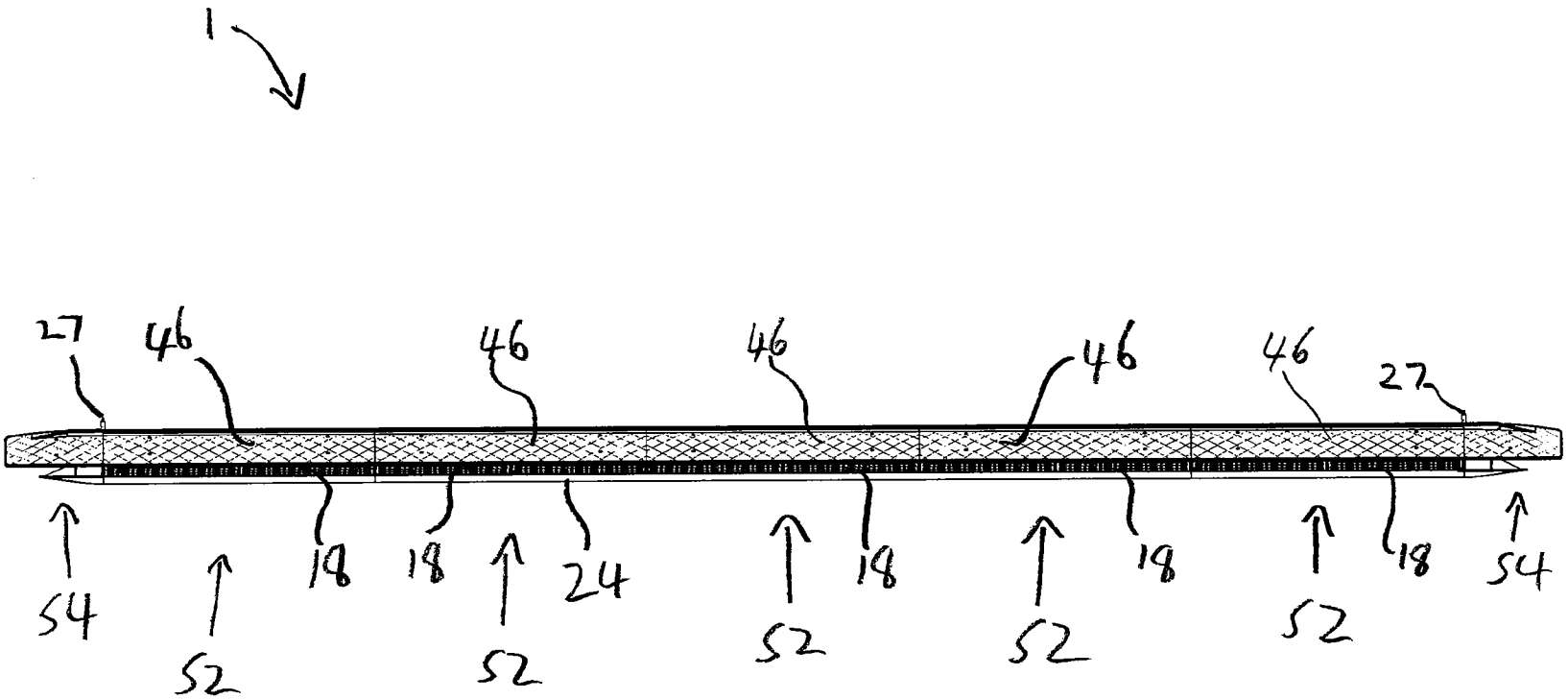
FIG. 11 is a side view of an embodiment described herein.

In operation, two or more modules can be interconnected in the field in order to suit the unique characteristics and lighting needs of a particular installation site of the lighting apparatus. "T" shaped, "L" shaped or other angled modules can be provided in order to change the direction of a string of interconnected modules. As shown in FIG. 9, end caps 54 can be provided to terminate a string of interconnected modules.

Figure 12:
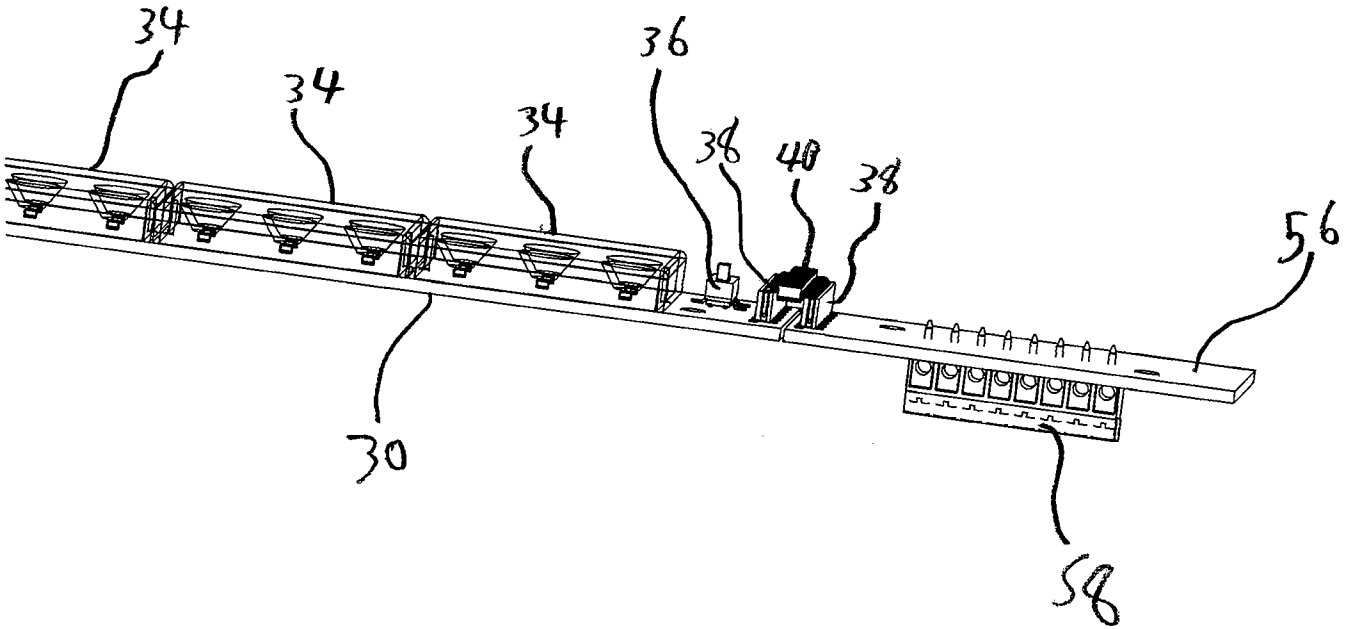
FIG. 12 is a perspective view of an embodiment described herein.

A controller 56 (shown in FIG. 12) for controlling one or more of the interconnected modules can be located within an end cap 54. In another embodiment, the controller 56 can be mounted at other locations on the lighting apparatus, or can be separated from the lighting apparatus yet remain in communication with the lighting apparatus either through wired or wireless communication. In the embodiment depicted in FIG. 12, the controller 56 is a printed circuit board. The controller includes a terminal block 58 which allows power, communication or other wires to be connected to the controller 56.

In an embodiment, the lighting apparatus is a kit which includes two or more separated PCBs, and one or more male connectors for interconnecting the PCBs in the field. In another embodiment, the kit can also include one or more controllers for collectively or individually controlling one or more PCBs, or for controlling one or more groups of PCBs. In yet another embodiment, the kit can include any additional components or features described herein.

In operation of an embodiment, the controller 56 can transmit power and communication signals to an adjacent PCB 30 via male connector 40. PCB 30 can subsequently transmit power and communication signals to one or more additional interconnected PCBs, each of the adjacent PCBs being interconnected by a male connector 40.

In an embodiment, the controller 56 receives an input signal from one or more integrated or external signaling devices. In an embodiment, the signaling device can be an external occupancy sensor, a photo sensor, a timer, a manual dimmer control or any other type of signaling device. In operation on an embodiment, in response to an input signal received from a signaling device the controller generates an output signal for controlling one or more LEDs mounted on interconnected PCBs. The output signal can be a pulse width modulation ("PWM") signal in the range of zero to ten volts. In operation of an embodiment, the brightness of the LEDs of one or more PCBs can be varied via the PWM signal. The brightness of the LEDs, which in an embodiment are turning on and off at a frequency of 480 hertz, can be controlled via the PWM signal by varying the length of time that the LED remains on relative to the length of time that the LED remains off for each on/off cycle.

The toggle switch 36 of each PCB has a listen setting and an ignore setting. When toggled to the listen setting, the toggle switch listens for the PWM signal and allows the brightness of the LEDs of the corresponding PCB to be controlled in response to the PWM signal. When toggled to the ignore setting, the toggle switch does not listen for the PWM signal and the brightness of the LEDs of the corresponding PCB are not controlled in response to the PWM signal.

The listen and ignore setting of the toggle switch on each PCB of an interconnected string can be independently selected. For example, the toggle switches of one or more PCBs near an exterior window of a building can be set to the listen setting, while the toggle switches of one or more PCBs farther from an exterior window (where interior light levels are less influenced by the amount of day light entering the exterior window) can be set to the ignore setting. A photo sensor located near the exterior window can transmit a signal to the controller in response to varying levels of exterior brightness. The controller can then generate a PWM signal which dims the LEDs of the PCBs near the exterior window which have their toggle switch set to the listen setting. In contrast, the LEDs of the PCBs farther from the exterior window which have their toggle switches set to the ignore setting will not dim in response to the PWM signal. In an embodiment two or more interconnected PCBs and/or interconnected sections of PCBs can be independently controlled by two or more controllers. For example, in a shared working space office environment, each employee can be provided their own manual dimming control which is connected to its own controller. Each employee can then manually control the brightness of the LEDs which illuminate their own working space.

Figure 13:
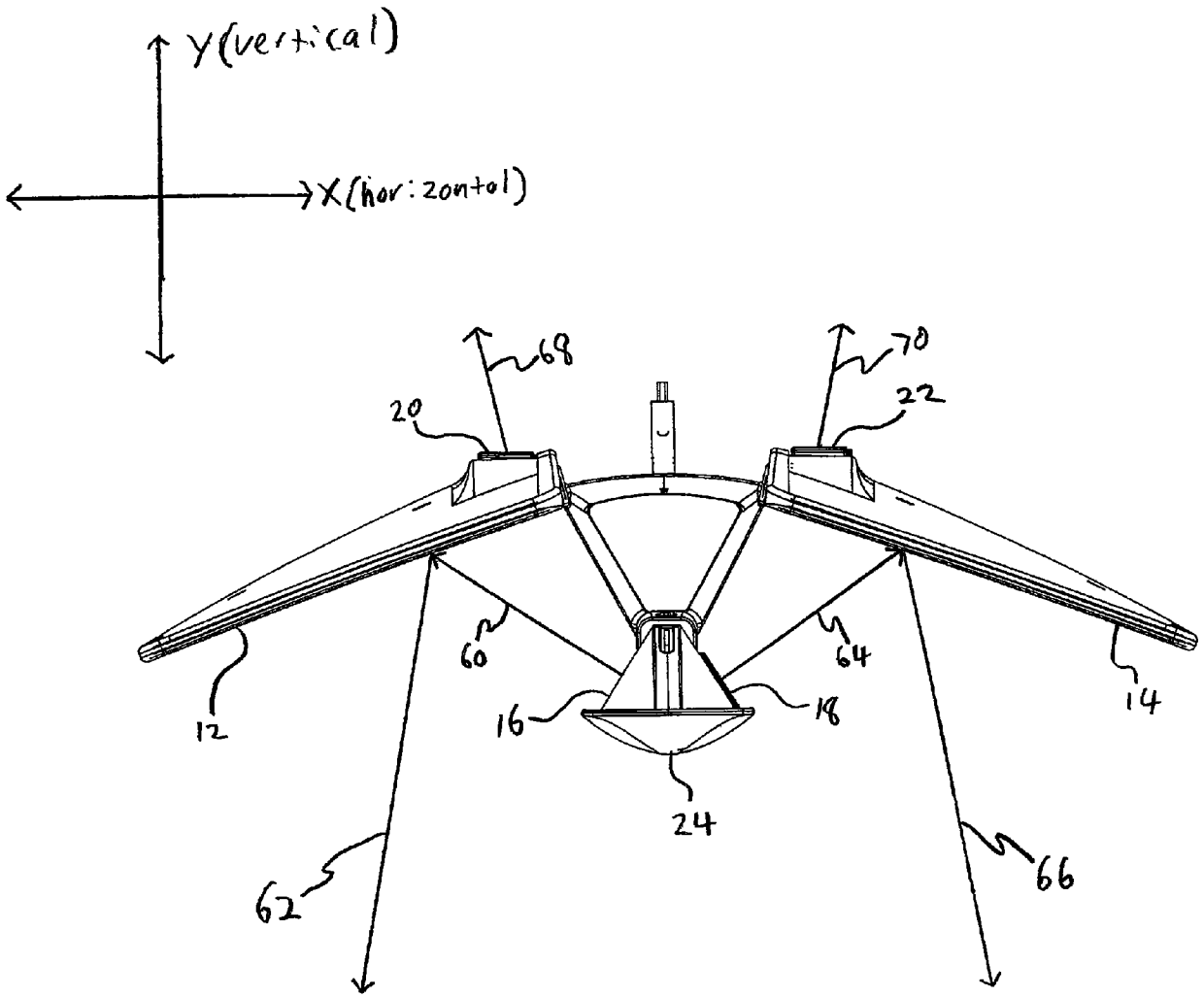
FIG. 13 is a front view of an embodiment described herein.
Figure 14:
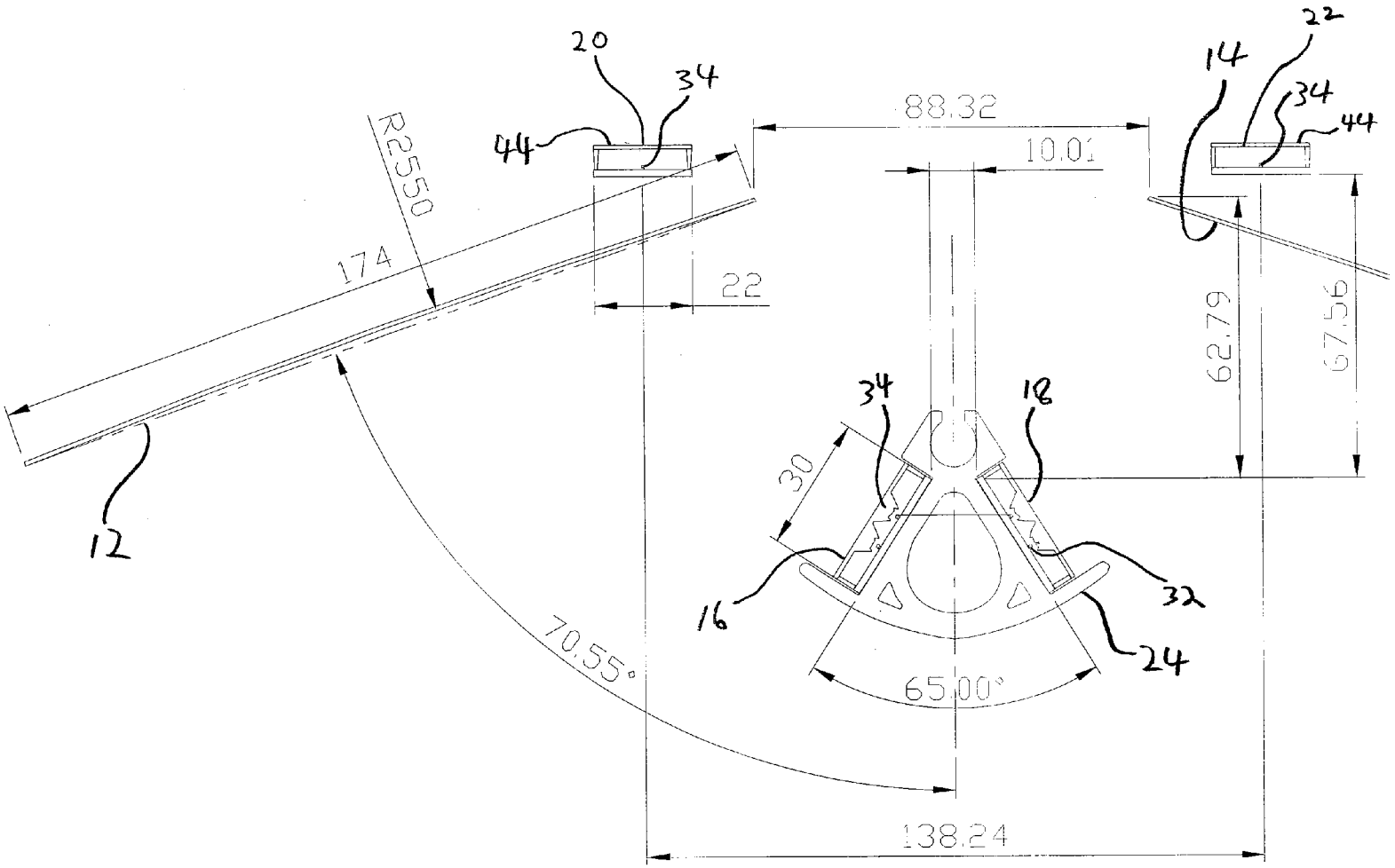
FIG. 14 is schematic of an embodiment described herein.
Figure 15:
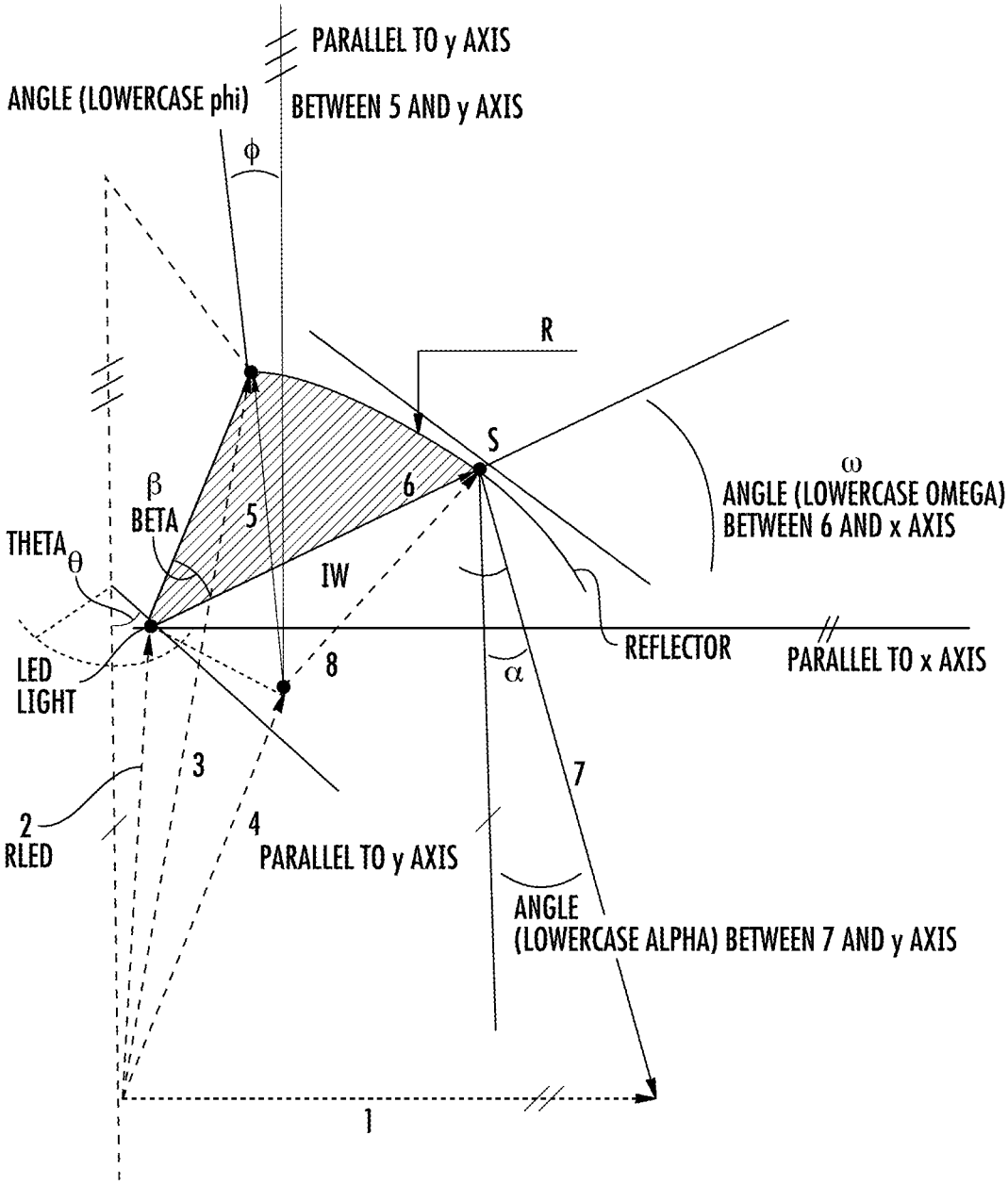
FIG. 15 is a schematic of an embodiment described herein.

Referring now to the embodiment depicted in FIGS. 13, 14 and 15, the LEDs of first downlight 16 are directed upward and toward the first reflector 12, and the LEDs of the second downlight 18 are directed upward and toward the second reflector 14. First uplight 20 and second uplight 22 are directed upward, such as toward a ceiling, and are not directed toward either the first reflector 12 or the second reflector 14. In an embodiment, the light output of the uplights 20 and 22 can illuminate a ceiling and create ambient light. In an embodiment, the uplights can be controlled by either the same controller or by a different controller from that which controls the downlights.

Referring still to the embodiments depicted in FIGS. 13, 14 and 15, the light output of an LED of the downlight 16 or of downlight 18 is initially in a cone of approximately 120×120 degrees. The light output first passes through a lens 34 (shown in FIG. 4) which focuses the light output and concentrates it into a cone of 55×55 degrees. In another embodiment, the light output is concentrated into a cone of 55×38 degrees. In still another embodiment, the light output is concentrated into a cone of 55×40 degrees. The light output of the first downlight 16 is focused onto the first reflector 12 and redirected downward. The light output of the second downlight 18 is focused onto the second reflector 14 and redirected downward. In an embodiment, the lighting apparatus allows for a maximum amount of the light output of a light source, such as the LEDs, to reach a desired area to be illuminated, as well as for an even distribution of light to illuminate that desired area.

Referring now to the embodiment depicted in FIG. 13, an LED of first downlight 16 has a light output with a central axis 60. The central axis 60 is at an angle greater than the horizontal and at an angle less than the vertical (which corresponds to the upper left quadrant of the x-y axes depicted in FIG. 13). In an embodiment, the central axis 60 is at an angle of 32.5 degrees relative to the horizontal. In another embodiment, the central axis 60 is at an angle in the range of about 30 degrees to about 35 degrees relative to the horizontal. In yet another embodiment, the central axis 60 is at an angle in the range of about 25 degrees to about 40 degrees relative to the horizontal. In still another embodiment, the central axis 60 is at an angle in the range of about 20 degrees to about 45 degrees relative to the horizontal.

Referring still to FIG. 13, the central axis 60 of the light output contacts the first reflector 12. The central axis 60 is then redirected as central axis 62 at an angle less than the horizontal and at an angle less than the vertical. In an embodiment, central axis 62 then contacts a table or work surface. As used herein, a table and a work surface are used interchangeably and include any surface, object or desired area to be illuminated.

Referring still to the embodiment depicted in FIG. 13, an LED of second downlight 18 has a light output with a central axis 64. The central axis 64 is at an angle greater than the horizontal and at an angle greater than the vertical (which corresponds to the upper right quadrant of the x-y axes depicted in FIG. 13). In an embodiment, the central axis 64 is at an angle of 32.5 degrees relative to the horizontal. In another embodiment, the central axis 64 is at an angle in the range of about 30 degrees to about 35 degrees relative to the horizontal. In yet another embodiment, the central axis 64 is at an angle in the range of about 25 degrees to about 40 degrees relative to the horizontal. In still another embodiment, the central axis 64 is at an angle in the range of about 20 degrees to about 45 degrees relative to the horizontal.

Referring still to FIG. 13, the central axis 64 of the light output contacts the second reflector 14. The central axis 64 is then redirected as central axis 66 at an angle less than the horizontal and at an angle greater than the vertical. In an embodiment, central axis 66 then contacts a table or work surface.

In the embodiment depicted in FIG. 13, the light output of the first uplight 20 has a central axis 68 at an angle greater than the horizontal and at an angle less than the vertical. The light output of the second uplight 22 has a central axis 70 at an angle greater than the horizontal and at an angle greater than the vertical.

As shown in the embodiment depicted in FIG. 14, the reflector can have a curvature. In the embodiment shown in FIG. 14, the reflector has a curvature with a radius of 2,550 millimeters. In an embodiment, the curvature of the reflector is not uniform. For example, the outside end of the reflector can have a greater curvature than the remainder of the reflector.

Referring to the embodiments depicted in FIGS. 13 and 14, the frame includes a heat sink 24. In an embodiment, the heat sink can be made of extruded aluminum. The shape of the heat sink 24 and the gap between first reflector 12 and second reflector 14 can allow heat generated by the LEDs of the first downlight 16 and the second downlight 18 to create a convection current and escape out of the gap between the reflectors.

Referring now to FIG. 15, in an embodiment the arrangement of the reflector, the light output of an uplight and a table is substantially according to the following system of formulas:

A. Definition of Variables

Given the measurable values:

$L_{Table}$
$L_{LED}$
$h_{LED}$
$L_{Pivot}$
$h_{Pivot}$
$L_{Center}$
$h_{Center}$
$\theta$
$\beta$
$\phi$
R Define position vectors of key components as such:

End of Table:

$$1.\ \frac{R\rightarrow_{Table\ End}}{R_{Table\ End}} = \frac{L_{Table}}{2}\hat{x}$$

LED Point Source:

$$2.\ \frac{R\rightarrow_{LED}}{R_{LED}} = L_{LED}\hat{x} + h_{LED}\hat{y}$$

Position of the Reflector:

$$3.\ \frac{R\rightarrow_{Pivot}}{R_{Pivot}} = L_{Pivot}\hat{x} + h_{Pivot}\hat{y}$$

$$4.\ \frac{R\rightarrow_{Center}}{R_{Center}} = L_{Center}\hat{x} + h_{Center}\hat{y}$$

Define relationship vectors between key components as such:

$$5.\ \frac{R\rightarrow_{Center\ to\ Pivot}}{R_{Center\ to\ Pivot}} = \overline{R}\sin\phi\hat{x} + \overline{R}\cos\phi\hat{y}$$

$$6.\ \frac{R\rightarrow_{LEDtoS}}{R_{LED\ to\ S}} = M\cos\omega\hat{x} + M\sin\omega\hat{y}$$

(where S is the incidence point on the reflector of the outermost ray of the LED light cone; where M is a magnitude that can be solved for in terms of known units)

$$7.\ \frac{R\rightarrow_{StoTableEnd}}{R_{S\ to\ Table\ End}} = N\sin\alpha\hat{x} + N\cos\alpha\hat{y}$$

(where N is a magnitude that can be solved for in terms of known units)

$$8.\ \frac{R\rightarrow_{CentertoS}}{R_{Center\ to\ S}} = R\sin\left(45 - \frac{\omega}{2} + \frac{\alpha}{2}\right)\hat{x} + R\cos\left(45 - \frac{\omega}{2} + \frac{\alpha}{2}\right)\hat{y}$$

B. Geometry

The following are geometric relations:

$$\omega = \theta - \frac{\beta}{2}$$

C. System of Equations

Given these definitions, we construct a system of equations which constrain the outermost ray of the LED's light cone to fall at the edge of the table.

$$h_{LED} + M\sin\omega + N\cos\alpha = 0 \qquad \text{Equation 1}$$

$$L_{LED} + M\cos\omega + N\sin\alpha = \frac{L_{Table\ End}}{2} \qquad \text{Equation 2}$$

$$L_{LED} - L_{center} + M\cos\omega = R\sin\left(45 - \frac{\omega}{2} + \frac{\alpha}{2}\right) \qquad \text{Equation 3}$$

$$h_{LED} - h_{center} + M\sin\omega = R\cos\left(45 - \frac{\omega}{2} + \frac{\alpha}{2}\right) \qquad \text{Equation 4}$$

The embodiments shown in the drawings and described above are exemplary of numerous embodiments that may be made within the scope of the appended claims. It is contemplated that numerous other configurations may be used, and the material of each component may be selected from numerous materials other than those specifically disclosed. In short, it is the applicant's intention that the scope of the patent issuing herefrom will be limited only by the scope of the appended claims.

We claim:

1. A lighting apparatus comprising:

a) a frame;

b) a first base connected to said frame;

c) an LED mounted on said first base, said LED of said first base having a light output with a central axis, the central axis of the light output being at an angle greater than the horizontal and at an angle less than the vertical;

d) a first reflector connected to said frame;

e) a first lens mounted over said LED of said first base, such that at least a portion of the light output of said LED of said first base is focused by said first lens onto said first reflector, and redirected at an angle less than the horizontal by said first reflector;

f) a second base connected to said frame;

g) an LED mounted on said second base, said LED of said second base having a light output with a central axis, the central axis of the light output being at an angle greater than the horizontal and at an angle greater than the vertical;

h) a second reflector connected to said frame; and i) a second lens mounted over said LED of said second base, such that at least a portion of the light output of said LED of said second base is focused by said second lens onto said second reflector, and redirected at an angle less than the horizontal by said second reflector.

2. The lighting apparatus of claim 1 further comprising:

a) a third base connected to said frame; and b) an LED mounted on said third base, said LED of said third base having a light output with a central axis, the central axis of the light output being at an angle greater than the horizontal, and wherein the light output of said LED of said third base is not directed toward either said first reflector or said second reflector.

3. The lighting apparatus of claim 2 wherein the central axis of the light output of said LED of said third base is at an angle less than the vertical; and further comprising:

a) a fourth base connected to said frame; and b) an LED mounted on said fourth base, said LED of said fourth base having a light output with a central axis, the central axis of the light output being at an angle greater than the horizontal and at an angle greater than the vertical, and wherein the light output of said LED of said fourth base is not directed toward either said first reflector or said second reflector.

4. A lighting apparatus comprising:

a) a frame;

b) a first light source connected to said frame, said first light source having a light output with a central axis, the central axis of the light output of the first light source being at an angle greater than the horizontal and at an angle less than the vertical;

c) a first reflector connected to said frame;

d) a first lens connected to said frame and positioned between said first light source and said first reflector, such that at least a portion of the light output of said first light source passes through said first lens, and is redirected by said first reflector;

e) a second light source connected to said frame, said second light source having a light output with a central axis, the central axis of the light output of the second light source being at an angle greater than the horizontal and at an angle greater than the vertical;

f) a second reflector connected to said frame; and g) a second lens connected to said frame and positioned between said second light source and said second reflector, such that at least a portion of the light output of said second light source passes through said second lens, and is redirected by said second reflector.

5. The lighting apparatus of claim 4 further comprising a third light source connected to said frame, said third light source having a light output with a central axis, and wherein the light output of said third light source is not directed toward either said first reflector or said second reflector.

6. The lighting apparatus of claim 5 further comprising a fourth light source connected to said frame, said fourth light source having a light output with a central axis, and wherein the light output of said fourth light source is not directed toward either said first reflector or said second reflector.

7. The lighting apparatus of claim 6 wherein the central axis of the light output of the third light source is at an angle greater than the horizontal and at an angle less than the vertical, and the central axis of the light output of the fourth light source is at an angle greater than the horizontal and at an angle greater than the vertical.

8. The lighting apparatus of claim 7 wherein said first light source comprises a plurality of LEDs; said second light source comprises a plurality of LEDs; said third light source comprises a plurality of LEDs; and said fourth light source comprises a plurality of LEDs.

9. The lighting apparatus of claim 4 wherein said first light source comprises a plurality of LEDs; and said second light source comprises a plurality of LEDs.

10. The lighting apparatus of claim 4 wherein said first light source comprises an LED.

11. The lighting apparatus of claim 4 wherein said first light source comprises a plurality of LEDs.

12. A lighting apparatus comprising:

a) a first light source having a light output with a central axis, wherein said first light source further comprises:

i) at least two interconnected printed circuit boards; and ii) a plurality of LEDs mounted on each of said at least two interconnected printed circuit boards;

b) a first reflector; and c) a first lens positioned between said first light source and said first reflector, such that at least a portion of the light output of said first light source passes through said first lens, and is redirected by said first reflector.

13. The lighting apparatus of claim 12 further comprising a controller in communication with at least one of said printed circuit boards.

14. The lighting apparatus of claim 13 further comprising a pulse width modulation signal generated by said controller for communication with at least one of said printed circuit boards.

15. The lighting apparatus of claim 14 wherein said plurality of LEDs mounted on at least one of said printed circuit boards are dimmed in response to said pulse width modulation signal.

16. The lighting apparatus of claim 14 further comprising a toggle switch in communication with said controller and in communication with at least one of said printed circuit boards, said toggle switch having a listen setting and an ignore setting, wherein said listen setting listens for a pulse width modulation signal and said ignore setting ignores a pulse width modulation signal.

17. The lighting apparatus of claim 16 wherein said plurality of LEDs mounted on at least one of said printed circuit boards are dimmed in response to said pulse width modulation signal when said toggle switch is set to said listen setting.

18. The lighting apparatus of claim 13 further comprising a pulse width modulation signal generated by said controller for communicating with at least two of said printed circuit boards.

19. The lighting apparatus of claim 14 further comprising at least one additional pulse width modulation signal for independently communicating with at least one other of said printed circuit boards.

20. The lighting apparatus of claim 12 wherein said at least two interconnected printed circuit boards are releasably interconnected.

21. The lighting apparatus of claim 14 wherein said controller is in communication with an input device selected from the group consisting of a daylight sensor, an occupancy sensor and a manual dimming control.

22. The lighting apparatus of claim 12, wherein the arrangement of said reflector, the light output of the first light source and a work surface is substantially according to the following equations:

$$h_{LED} + M\sin\omega + N\cos\alpha = 0 \quad \text{equation 1}$$

$$L_{LED} + M\cos\omega + N\sin\alpha = \frac{L_{Table\ End}}{2} \quad \text{equation 2}$$

$$L_{LED} - L_{center} + M\cos\omega = R\sin\left(45 - \frac{\omega}{2} + \frac{\alpha}{2}\right) \quad \text{equation 3}$$

$$h_{LED} - h_{center} + M\sin\omega = R\cos\left(45 - \frac{\omega}{2} + \frac{\alpha}{2}\right). \quad \text{equation 4}$$

23. A lighting apparatus kit having component parts capable of being assembled in the field, the kit comprising the combination of:

a) a controller adapted to generate a pulse width modulation signal;

b) a plurality of printed circuit boards, each of said plurality of printed circuit boards comprising:

i) a plurality of LEDs mounted on each of said printed circuit boards; and ii) a toggle switch capable of being in communication with said controller, said toggle switch having a listen setting and an ignore setting, wherein said listen setting listens for a pulse width modulation signal and said ignore setting ignores a pulse width modulation signal; and c) each of said plurality of printed circuit boards adapted to be releasably interconnected to at least one other of said printed circuit boards.

24. The lighting apparatus kit of claim 23 further comprising a frame, said plurality of printed circuit boards adapted to be mounted to said frame.

25. The lighting apparatus kit of claim 24 further comprising a plurality of interchangeable reflectors, each of said reflectors adapted to be mounted to said frame.

26. The lighting apparatus kit of claim 25 further comprising a lens mounted over at least one of said plurality of LEDs.

27. A method of illuminating an area comprising:

a) outputting light from an LED;

b) focusing the light onto a reflector;

c) redirecting the light; and d) arranging the reflector and the light outputted by the LED, such that the arrangement of the reflector, the light outputted by said LED and a work surface is substantially according to the following equations:

$$h_{LED} + M\sin\omega + N\cos\alpha = 0 \quad \text{equation 1}$$

$$L_{LED} + M\cos\omega + N\sin\alpha = \frac{L_{Table\ End}}{2} \quad \text{equation 2}$$

$$L_{LED} - L_{center} + M\cos\omega = R\sin\left(45 - \frac{\omega}{2} + \frac{\alpha}{2}\right) \quad \text{equation 3}$$

$$h_{LED} - h_{center} + M\sin\omega = R\cos\left(45 - \frac{\omega}{2} + \frac{\alpha}{2}\right). \quad \text{equation 4}$$

28. The method of claim 27 wherein said focusing the light further comprises concentrating the light.

29. The method of claim 27 wherein steps a) through c) are performed in order.

* * * * *